US009429128B2

(12) United States Patent
Gunji et al.

(10) Patent No.: US 9,429,128 B2
(45) Date of Patent: Aug. 30, 2016

(54) METHOD FOR ADJUSTING STROKE OF FUEL INJECTION VALVE, AND FUEL INJECTION VALVE

(75) Inventors: Kenichi Gunji, Hitachinaka (JP); Shin Onose, Hitachinaka (JP); Takeshi Matsumaru, Hitachinaka (JP); Katsuya Oonuki, Hitachinaka (JP); Makoto Matsutate, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 253 days.

(21) Appl. No.: 14/116,251

(22) PCT Filed: Apr. 20, 2012

(86) PCT No.: PCT/JP2012/060676

§ 371 (c)(1),
(2), (4) Date: Nov. 7, 2013

(87) PCT Pub. No.: WO2012/157400

PCT Pub. Date: Nov. 22, 2012

(65) Prior Publication Data

US 2014/0076284 A1 Mar. 20, 2014

(30) Foreign Application Priority Data

May 13, 2011 (JP) ..... 2011-107777

(51) Int. Cl.

*F02M 61/16* (2006.01)
*F02M 69/04* (2006.01)
*F02M 51/06* (2006.01)

(52) U.S. Cl.

CPC ..... *F02M 69/04* (2013.01); *F02M 51/0671* (2013.01); *F02M 61/161* (2013.01); *F02M 2200/8053* (2013.01); *F02M 2200/8084* (2013.01); *F02M 2200/8092* (2013.01)

(58) Field of Classification Search

CPC ..... F02M 61/161; F02M 2200/8053; F02M 2200/8084; F02M 2200/8092
USPC ..... 73/114.45, 114.46, 114.47, 114.48, 73/114.49, 114.51
See application file for complete search history.

(56) References Cited

U.S. PATENT DOCUMENTS 5,263,648 A * 11/1993 Vogt et al. ..... 239/585.4
5,307,991 A * 5/1994 Hanson et al. ..... 239/1
5,713,523 A 2/1998 Fujikawa (Continued)

FOREIGN PATENT DOCUMENTS

JP 08-189439 7/1996
JP 8-189439 A 7/1996

(Continued)

OTHER PUBLICATIONS

PCT International Search Report on application PCT/JP2012/060676 mailed Jul. 24, 2012; 4 pages.

*Primary Examiner* — Eric S McCall
(74) *Attorney, Agent, or Firm* — Foley & Lardner LLP

(57) ABSTRACT

An objection of the present invention is to provide a fuel injection valve with a reduced variation in an injection amount and, in order to achieve this object, a method for adjusting stroke, the method being able to correct change in an amount of stroke caused by welding. In the method for adjusting the amount of stroke of a movable member of a fuel injection valve including a nozzle member having a seat face, a nozzle holder member to which the nozzle member is joined by welding, and the movable member having a valve seat portion for coming in contact with the seat face, the amount of stroke of the movable member is adjusted by plastically deforming a deformable portion provided to the nozzle holder member after joining the nozzle member and the nozzle holder member by welding.

6 Claims, 9 Drawing Sheets

(56) References Cited

U.S. PATENT DOCUMENTS

| | | | | |
|---|---|---|---|---|
| 6,435,429 | B1 * | 8/2002 | Eichendorf et al. | 239/585.1 |
| 2001/0030249 | A1 * | 10/2001 | Nagasaka et al. | 239/585.1 |
| 2004/0041038 | A1 * | 3/2004 | Delaney et al. | 239/585.1 |
| 2008/0296414 | A1 | 12/2008 | Kubota et al. | |
| 2009/0179089 | A1 * | 7/2009 | Coha et al. | 239/585.1 |
| 2009/0282682 | A1 * | 11/2009 | Perry | 29/890.129 |
| 2011/0005077 | A1 * | 1/2011 | Higuma | F02M 61/168 29/890.142 |
| 2011/0011954 | A1 * | 1/2011 | Gunji | F02M 61/168 239/533.3 |
| 2011/0042490 | A1 * | 2/2011 | Gunji | F02M 61/168 239/584 |

FOREIGN PATENT DOCUMENTS

| | | | |
|---|---|---|---|
| JP | 2000-515947 | A | 11/2000 |
| JP | 2008-297966 | A | 12/2008 |

* cited by examiner

METHOD FOR ADJUSTING STROKE OF FUEL INJECTION VALVE, AND FUEL INJECTION VALVE

TECHNICAL FIELD

The present invention relates to a method for adjusting stroke of a fuel injection valve used for an internal combustion engine.

BACKGROUND ART

PTL 1 discloses, as a method for adjusting stroke of a fuel injection valve, a structure in which an outer circumference of a nozzle member 2 is press-fitted into a nozzle holder portion 3, a corner portion 2*a* provided to an end face of the nozzle member 2 bites into a corner portion 3*a* provided to a nozzle holder portion 3, the corner portion 3*a* is plastically deformed to form a crushed portion, and the nozzle member 2 and the nozzle holder portion 3 are joined and sealed by beads 5*a* connected in a ring shape by a laser welding method or an electronic beam welding method.

CITATION LIST

Patent Literature

PTL 1: JP 2008-297966 A

SUMMARY OF INVENTION

Technical Problem

In the method for adjusting the stroke in PTL 1, one of part of the nozzle member and part of the nozzle holder portion is caused to bite into the other in a stroke direction of a movable member to adjust the stroke and the portion plastically deformed at the time of biting mechanically prevents change (especially, change in a contracting direction caused when a melted portion solidifies) of the stroke due to distortion caused in welding of the nozzle member and the nozzle holder portion in a later step.

With the method for adjusting the stroke in PTL 1, it is possible to suppress large deformation of a few micrometers to over ten micrometers in the contracting direction. However, it is difficult to prevent stroke change smaller than a few micrometers due to a variation in contraction stress caused when the melted portion solidifies and stroke change smaller than a few micrometers in an increasing direction of the stroke when the nozzle member and the nozzle holder expand under influence of heat of welding. From an amount of stroke adjusted in a stroke adjustment before the welding, an amount of stroke after the welding may have changed about ±1 to 3 μm. Because there is a correlation between the amount of stroke and a fuel injection amount and change in the amount of stroke results in change in the injection amount. Therefore, the change in the amount of stroke after the welding may cause a variation in the injection amount of the fuel injection valve.

An objection of the present invention is to provide a fuel injection valve with a reduced variation in an injection amount and, in order to achieve this object, a method for adjusting stroke, the method being able to correct change in an amount of stroke caused by welding.

Solution to Problem

In order to achieve the above objection, a method for adjusting an amount of stroke according to the present invention is a method for adjusting an amount of stroke of a movable member of a fuel injection valve including a nozzle member having a seat face, a nozzle holder member to which the nozzle member is joined by welding, and the movable member having a valve seat portion for coming in contact with the seat face, wherein the amount of stroke of the movable member is adjusted by plastically deforming a deformable portion provided to the nozzle holder member after joining the nozzle member and the nozzle holder member by welding.

Here, it is preferable that the deformable portion is provided between a load applied portion of the fuel injection valve where a load for plastically deforming the deformable portion is applied and a supported portion of the fuel injection valve to be supported to receive the load and the deformable portion has lower rigidity in a valve axial direction against the load than the other portion between the load applied portion and the supported portion.

Further, it is preferable that a first stroke adjustment is carried out before joining the nozzle member and the nozzle holder member by welding and a stroke adjustment for plastically deforming the deformable portion after the joining by welding is carried out as a second stroke adjustment.

Further, it is preferable that the first stroke adjustment is for adjusting relative positions of the nozzle member and the nozzle holder member in the valve axial direction.

Further, it is preferable that the first stroke adjustment is carried out by supporting a side of the nozzle holder member and applying a pressing load to the nozzle member to push the nozzle member into the nozzle holder member and the second stroke adjustment is carried out by supporting the side of the nozzle holder member and applying a pressing load to the nozzle member.

Further, it is preferable that the supported portion of the fuel injection valve in the first stroke adjustment is positioned closer to the load applied portion than the supported portion in the second stroke adjustment. Alternatively, it is preferable that the deformable portion is formed after carrying out the first stroke adjustment.

Further, in order to achieve the above objection, a fuel injection valve according to the present invention includes: a nozzle member having a seat face; a nozzle holder member to which the nozzle member is joined by welding; and a movable member having a seat portion for coming in contact with the seat face, wherein a deformable portion, which is easier to plastically deform than the other portion of the nozzle holder member, is provided to the nozzle holder member, for adjustment of an amount of stroke of the movable member after the nozzle member and the nozzle holder member are joined by welding.

Advantageous Effects of Invention

According to the invention, change in an amount of stroke caused by welding after adjustment of the stroke can be corrected, the amount of stroke can be adjusted with high accuracy to a target amount of stroke, and a variation in an injection amount of the fuel injection valve can be reduced. Moreover, by providing the deformable portion for the second stroke adjustment, it is possible to set a lower load for the second stroke adjustment than in the first stroke adjustment, which prevents damage to a junction. As a result, it is possible to provide a highly reliable fuel injection valve.

DESCRIPTION OF EMBODIMENT

An embodiment of the present invention will be described based on the drawings.

Figure 1:
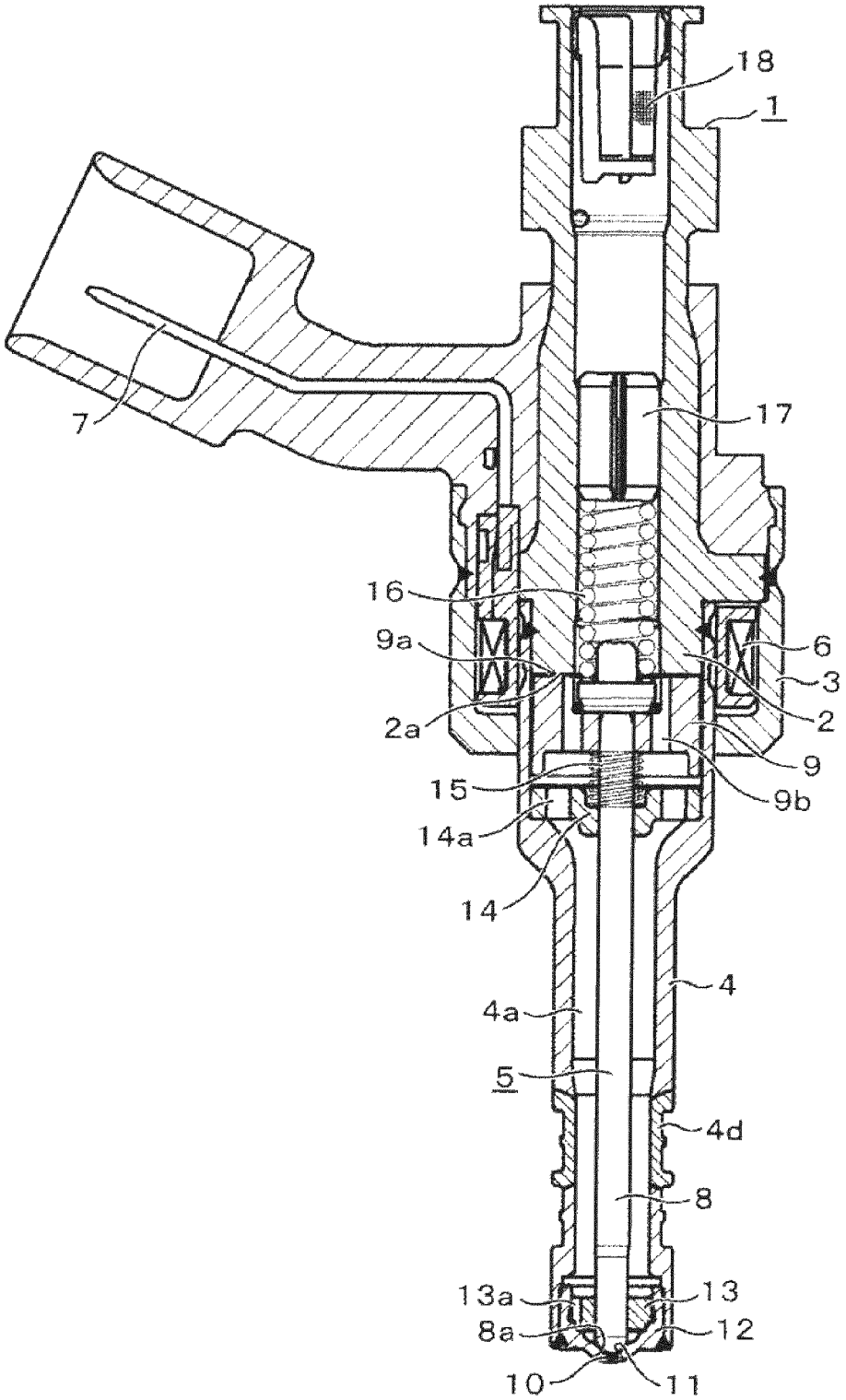
FIG. 1 is a vertical sectional view of a fuel injection valve according to a first embodiment of the present invention.

FIG. 1 is a vertical sectional view of a general structure of a fuel injection valve according to the embodiment of the invention.

The fuel injection valve 1 is mainly formed by a magnetic circuit portion and a valve portion and the magnetic circuit portion is formed by a fixed core 2, a yoke 3, a nozzle holder 4, a movable member 5, a coil 6 for exciting the magnetic circuit, and a connector terminal 7 for energizing the coil 6. The valve portion is formed by the movable member 5, including a valve element 8 and a movable core 9 housed in the nozzle holder 4, and a nozzle 12 having an orifice 10 and a seat face 11. Each of the nozzle holder 4 and the nozzle 12 is formed by a single member. The valve element 8 is supported for sliding by a guide 13 fixed in the nozzle 12 and a guide plate 14 fixed in the nozzle holder 4. The movable core 9 is pushed against the fixed core 2 by a biasing force of a spring 15.

Disposed in the fixed core 2 are a spring 16 for pressing the valve element 8 against the seat face 11, an adjuster 17 for adjusting a pressing load of the spring 16, and a filter 18 for preventing entry of contaminants from outside.

Next, operation of the fuel injection valve 1 will be described.

If the coil 6 is energized, the movable member 5 is attracted toward the fixed core 2 against a biasing force of the spring 16 and a movable core end face 9*a* comes in contact with a fixed core end face 2*a* to form a clearance between a valve seat portion 8*a* at a tip end of the movable member 5 and the seat face 11 (an open state of the valve). Pressurized fuel comes into the nozzle holder 4 via the fixed core 2, the adjuster 17, the spring 16, and a fuel passage 9*b* in the movable core 9. Next, the fuel passes through a fuel passage 14*a* in the guide plate 14, a passage 4*a* in the nozzle holder 4, and a passage 13*a* of the guide 13 and is injected from the clearance between the valve seat portion 8*a* and the seat face 11 through the orifice 10.

On the other hand, if an electric current through the coil 6 is interrupted, the valve seat portion 8*a* of the movable member 5 is brought in contact with the seat face 11 by the force of the spring 16 to come into a closed state of the valve.

By turning the electric current to the coil 6 on and off as described above, the movable member 5 is opened and closed to control a valve opening time to thereby inject necessary fuel.

Figure 2:
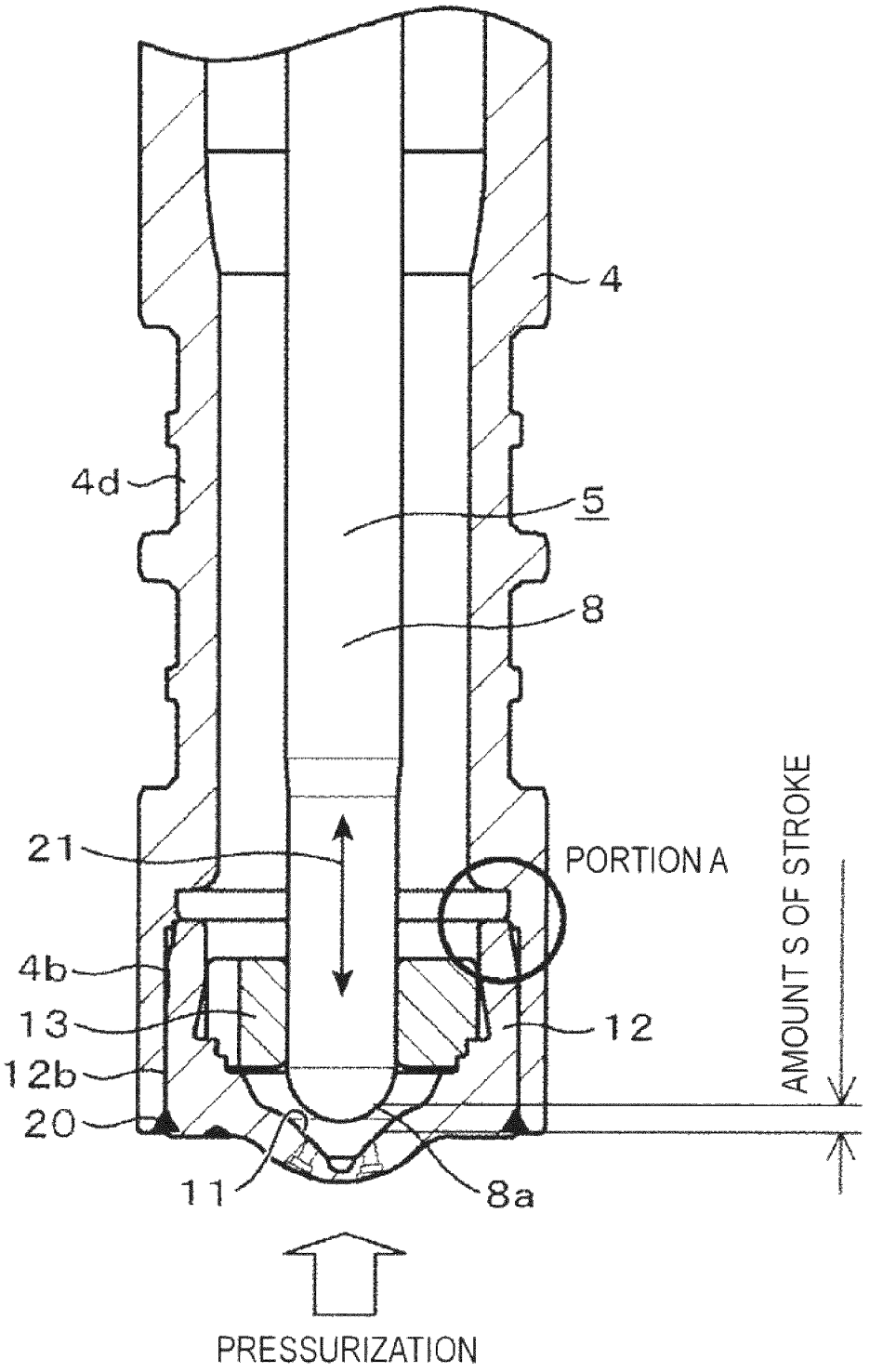
FIG. 2 is a sectional view of a portion of the fuel injection valve shown in FIG. 1.
Figure 3:
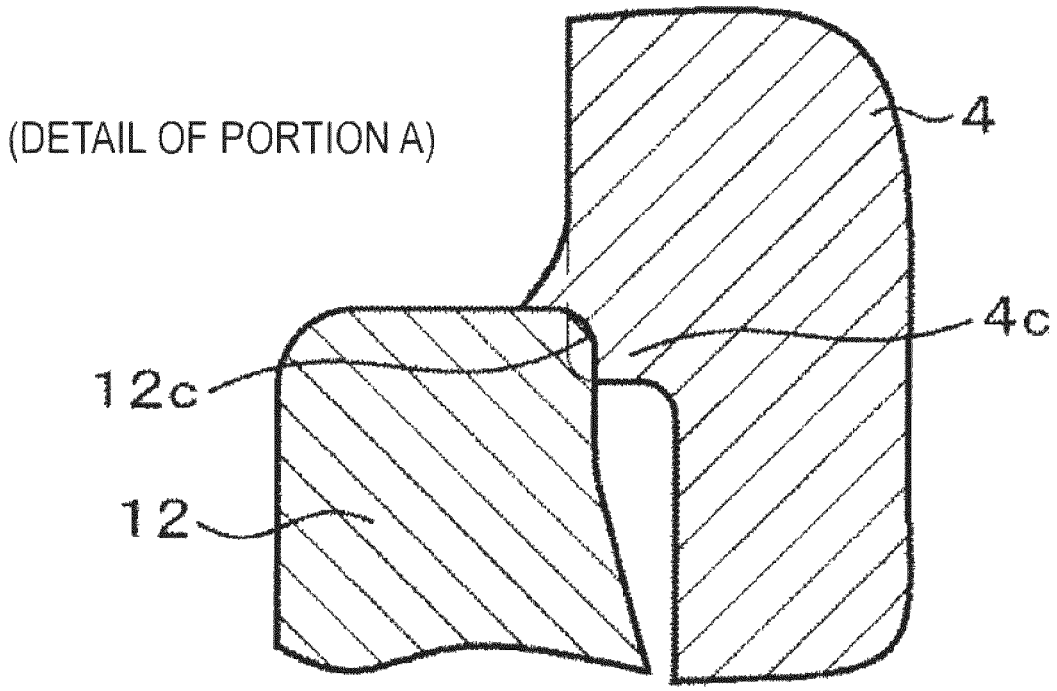
FIG. 3 is an enlarged sectional view of portion A of the fuel injection valve shown in FIG. 2.

An amount of stroke of the fuel injection valve 1 and adjustments of the amount of stroke will be described by using FIGS. 1, 2, and 3.

The amount S of stroke is defined as a length which the movable member 5 in the open state has moved from a contact face between the valve seat 8*a* and the seat face 11 in the closed state of the movable member 5. In the embodiment, the movable core 9 can be displaced with respect to the valve element 8. Therefore, when the movable core end face 9*a* collides with the fixed core end face 2*a* in valve opening and is prevented from moving in a valve opening direction, the valve element 8 may separate from the movable core 9 and continue to move alone in the valve opening direction in some cases. In such cases, the clearance between the valve seat portion 8*a* and the seat face 11 becomes greater than the amount S of stroke. However, the valve element 8 which has continued to move in the valve opening direction is pushed back in a valve closing direction by the biasing force of the spring 16, unites with the movable core 9 attracted to the fixed core end face 2*a* again, and stops. In the fuel injection valve formed so that the movable core 9 can be displaced with respect to the valve element 8 as in the embodiment, the clearance between the valve seat portion 8*a* and the seat face 11 when the valve element 8 unites with the movable core 9 and stops in the valve opening (to be exact, the clearance in a valve axial direction 21 at this time) is defined as the amount S of stroke.

The fixed core end face 2*a* forms a stopper portion for restricting the movement of the movable member 5 in the valve opening direction. In the embodiment, movement of the valve element 8 in the valve opening direction is not restricted by the fixed core end face 2*a* as described above. However, movement of the movable core 9, which is part of the movable member 5, in the valve opening direction is restricted by the fixed core end face 2*a*. By changing the clearance (distance) between the portion of the seat face 11 with which the valve seat portion 8*a* comes in contact and the stopper portion formed by the fixed core end face 2*a* in the valve axial direction 21, it is possible to adjust the amount S of stroke.

Next, the adjustments of the amount of stroke of the fuel injection valve 1 will be described.

First stroke adjustment is carried out to adjust an accumulated error (15 to 350 μm) which occurs when the fixed core 2, the nozzle holder 4, the valve element 8, the movable core 9, and the nozzle 12 are assembled and the amount S of stroke is adjusted in a position where the nozzle 12 is pushed into the nozzle holder 4.

In this step, a nozzle outer peripheral face 12*b* is press-fitted with a nozzle holder inner peripheral face 4*b* and is press-fitted deeper to thereby cause a nozzle edge portion 12*c* to bite into a nozzle holder edge portion 4*c* to adjust the stroke to predetermined stroke. Next, at a position shown with reference numeral 20, a boundary between the nozzle 12 and the nozzle holder 4 is welded in a circle by laser welding to join the nozzle 12 and the nozzle holder 4. At this time, accuracy of about ±1 μm or smaller of the stroke adjustment can be achieved with respect to a target value, when the nozzle 12 is caused to bite into the nozzle holder 4. However, when the nozzle 12 and the nozzle holder 4 are welded by laser welding, the accuracy reduces to about ±3 μm.

By causing the nozzle edge portion 12*c* to bite into the nozzle holder edge portion 4*c*, retraction of the nozzle 12 into the nozzle holder 4 due to solidification and contraction in the welding is prevented. However, in reality, a press-fitting load (a press-fitted margin) and a biting amount, and laser welding conditions vary and the stroke varies under influence of thermal expansion and contraction in melting and solidification steps of the welding, which worsens the accuracy of the adjustment. A load for the stroke adjustment at this time is in such a range that stress acting on a main body and a junction of the fuel injection valve 1 is within limits of elasticity so as not to deform the main body of the fuel injection valve 1 and damage the junction.

For this purpose, in the first stroke adjustment step, the amount of stroke is adjusted to an amount greater than the target amount of stroke by 5 to 10 μm, for example, and the nozzle 12 and the nozzle holder 4 are welded by the laser welding.

Figure 4:
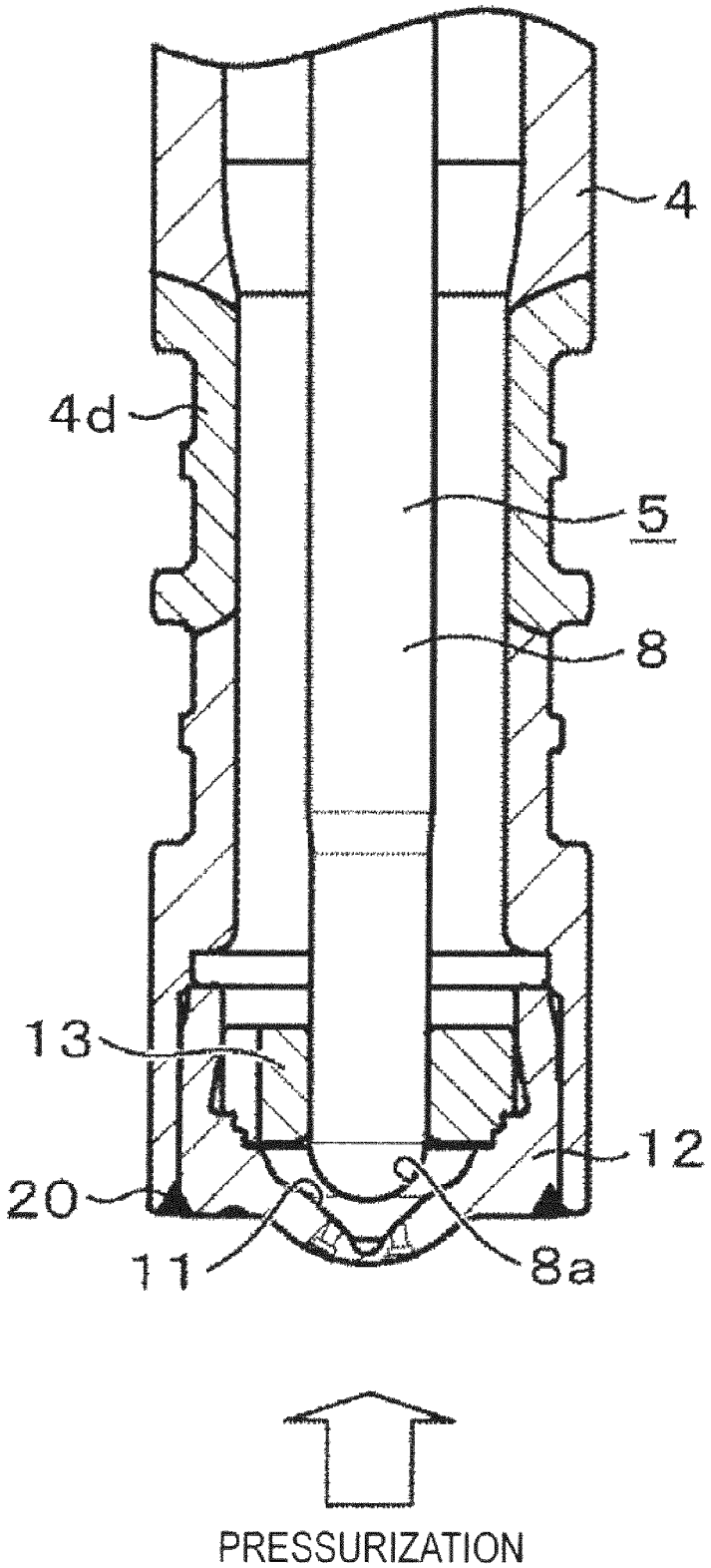
FIG. 4 is a vertical sectional view of a tip end of the fuel injection valve in which a deformable portion is formed.
Figure 5:
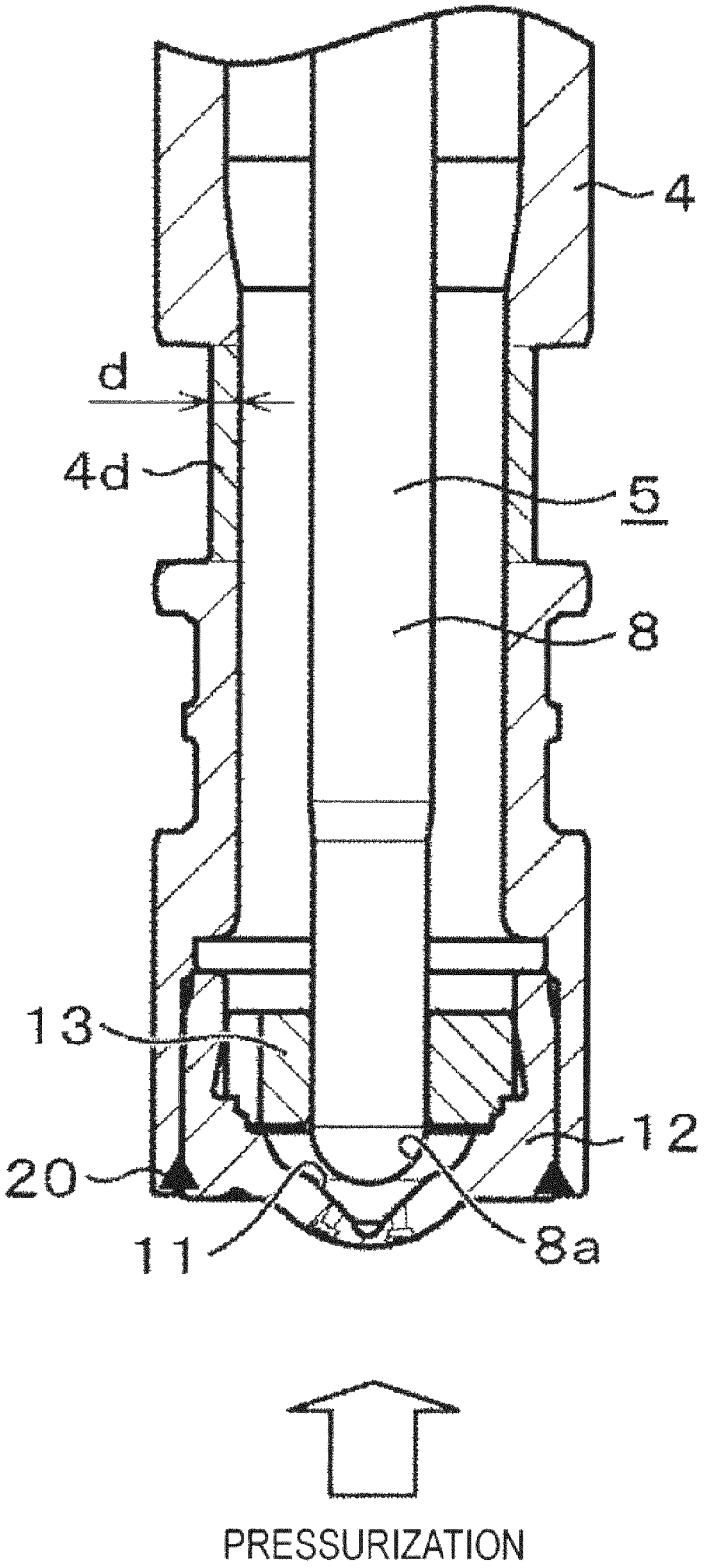
FIG. 5 is a vertical sectional view of a tip end of a fuel injection valve in which a deformable portion is formed.

Next, as shown in FIG. 4, in order to form the partial deformable portion 4*d* on the nozzle holder 4, the nozzle holder 4 is partially annealed by using a high-frequency heat treatment device. This is for the purpose of carrying out the second stroke adjustment later with a smaller load than the load for the first stroke adjustment. If the nozzle holder 4 is hardened by work hardening or quenching before the annealing, it is more effective. For example, the nozzle holder 4 which has been work-hardened to obtain Vickers hardness of Hv300 by forging or the like is softened to obtain Vickers hardness of Hv200 after the annealing. Besides the annealing, the method for forming the deformable portion 4*d* may be cutting carried out by machining so as to reduce thickness d as shown in FIG. 5. In other words, a portion in the same shape as the deformable portion 4*d* in FIG. 4 is subjected to the cutting instead of the annealing so that the thickness of this portion reduces. At this time, it is important to make sure the deformable portion 4*d* can be plastically deformed under a lower load in the second stroke adjustment carried out later than in the first stroke adjustment.

Then, as the second stroke adjustment, the nozzle 12 is pressed to plastically deform the deformable portion 4*d* of the nozzle holder 4 to thereby adjust the amount of stroke to a target value. At this time, the deformable portion 4*d* is work-hardened and therefore restores approximate strength to strength before the annealing.

The purposes of setting the lower load for the second stroke adjustment than for the first stroke adjustment are to prevent deformation of a welded portion and respective parts and not to impair reliability of the main body of the fuel injection valve 1.

As described above, because the variation in the stroke caused by the laser welding can be corrected by carrying out the second stroke adjustment, it is possible to maintain the amount of stroke with high accuracy which can be achieved in the stroke adjustment. In experiments, it was possible to reduce the variation in the amount of stroke of ±3 μm to ±1 μm or smaller. Moreover, because the variation in the amount of stroke is reduced to one third, a variation in the injection amount resulting from the variation in the stroke of the fuel injection valve can be reduced to one third.

Next, a method for adjusting the stroke of the fuel injection valve according to the embodiment will be described by using FIG. 6.

Figure 6:
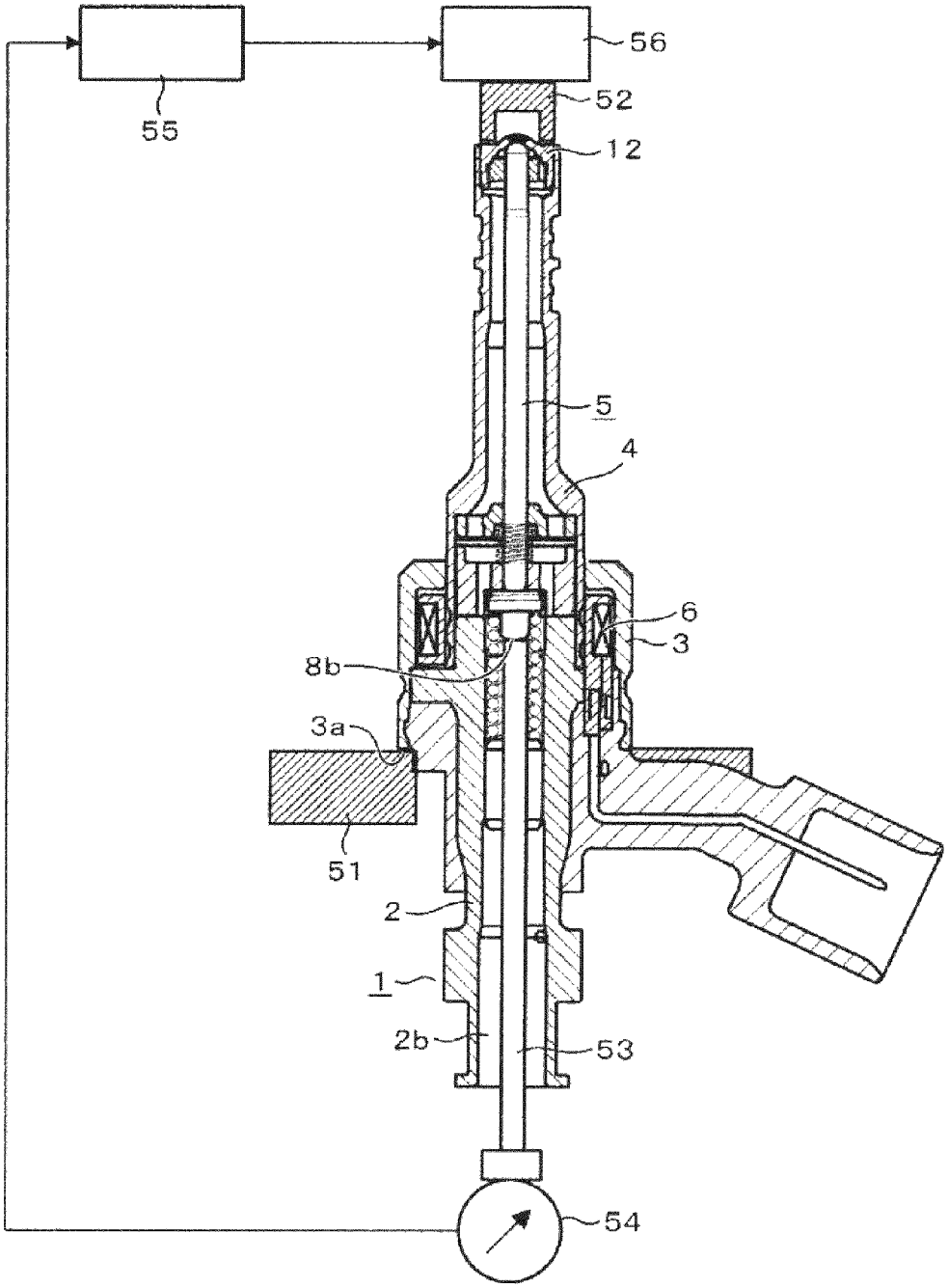
FIG. 6 shows a structure of a device for adjusting an amount of stroke.

FIG. 6 shows a structure of a device for adjusting the amount of stroke by measuring an amount of movement of the movable member 5.

The method for adjusting the stroke is carried out by receiving a yoke end face 3*a* with a retaining jig 51 and pushing in the tip end face of the nozzle 12 with a jig 52. At this time, a gage 53 is brought in contact with a lower end portion 8*b* of the movable member 5 through a hole 2*b* of the core, the movable member 5 is moved up and down by using an electromagnetic coil 6 to measure the amount S of stroke, and this data is fed back to control a push-in amount of the nozzle 12.

To put it concretely, the method is carried out as follows. The amount of stroke of the movable member 5 is measured by a measuring machine 54 through the gage 53. The measurement information is sent to a controller 55. The controller 55 calculates the push-in amount based on the measurement information of the stroke. The controller 55 generates a control signal based on the calculated push-in amount to control a push-in mechanism 56. When the push-in mechanism 56 receives the control signal from the controller 55, the push-in jig 52 pushes in the nozzle 12. This cycle is carried out once or more times to adjust the amount of stroke to a predetermined dimension.

Figure 7:
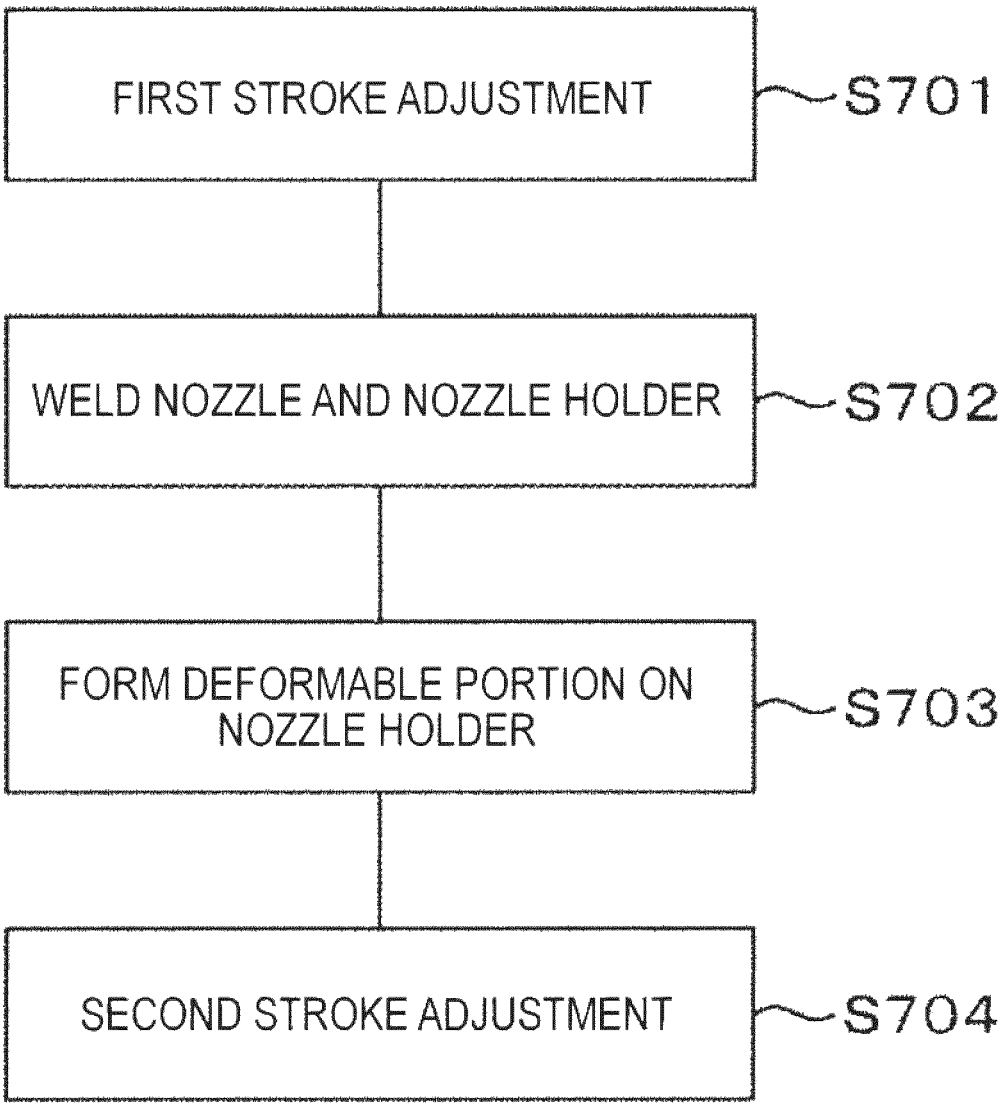
FIG. 7 shows a flowchart.

In the above-described method for adjusting the stroke, the same device is used for the first stroke adjustment and the second stroke adjustment. A process of the stroke adjustment is shown in the flowchart in FIG. 7. First, the first stroke adjustment is carried out (S701). At this time, as described above, the yoke end face 3*a* is received by the retaining jig 51 and the tip end face of the nozzle 12 is pushed in by the jig 52. In the first stroke adjustment, adjustment is carried out to cause the nozzle 12 to bite into the nozzle holder 4. After carrying out the first stroke adjustment, the nozzle 12 and the nozzle holder 4 are welded by the laser welding (S702). After carrying out the laser welding, the deformable portion 4*d* is formed (S703). After forming the deformable portion 4*d*, the second stroke adjustment is carried out (S704). In the second stroke adjustment, the adjustment is carried out by plastically deforming the deformable portion 4*d* of the nozzle holder 4. In the second stroke adjustment, in the same way as in the first stroke adjustment, a load receiving position can be set. In other words, the yoke end face 3*a* is received by the retaining jig 51 and the tip end face of the nozzle 12 is pushed in by the jig 52. Because the deformable portion 4*d* is formed after carrying out the first stroke adjustment, the deformable portion 4*d* does not exist in the first stroke adjustment and a portion to be provided with the deformable portion 4*d* is not deformed. In the second stroke adjustment, by receiving the yoke end face 3*a* with the retaining jig 51 and pushing in the tip end face of the nozzle 12 with the jig 52 in the same way as in the first stroke adjustment, it is possible to plastically deform the deformable portion 4*d*.

In this way, it is possible to provide a high-performance fuel injection valve with high stroke accuracy and the reduced variation in the injection amount.

Figure 8:
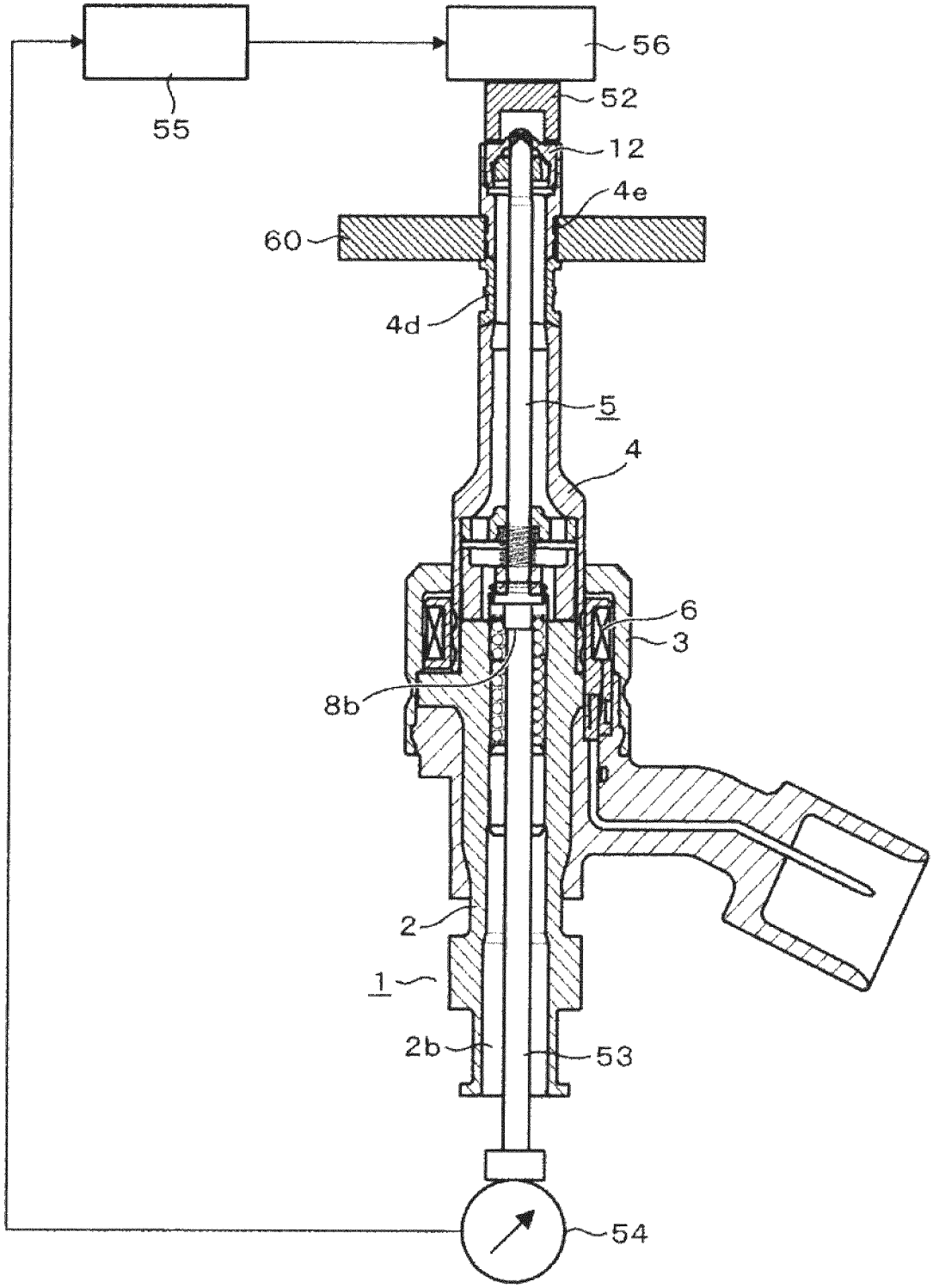
FIG. 8 shows a structure of a device for adjusting the amount of stroke.
Figure 9:
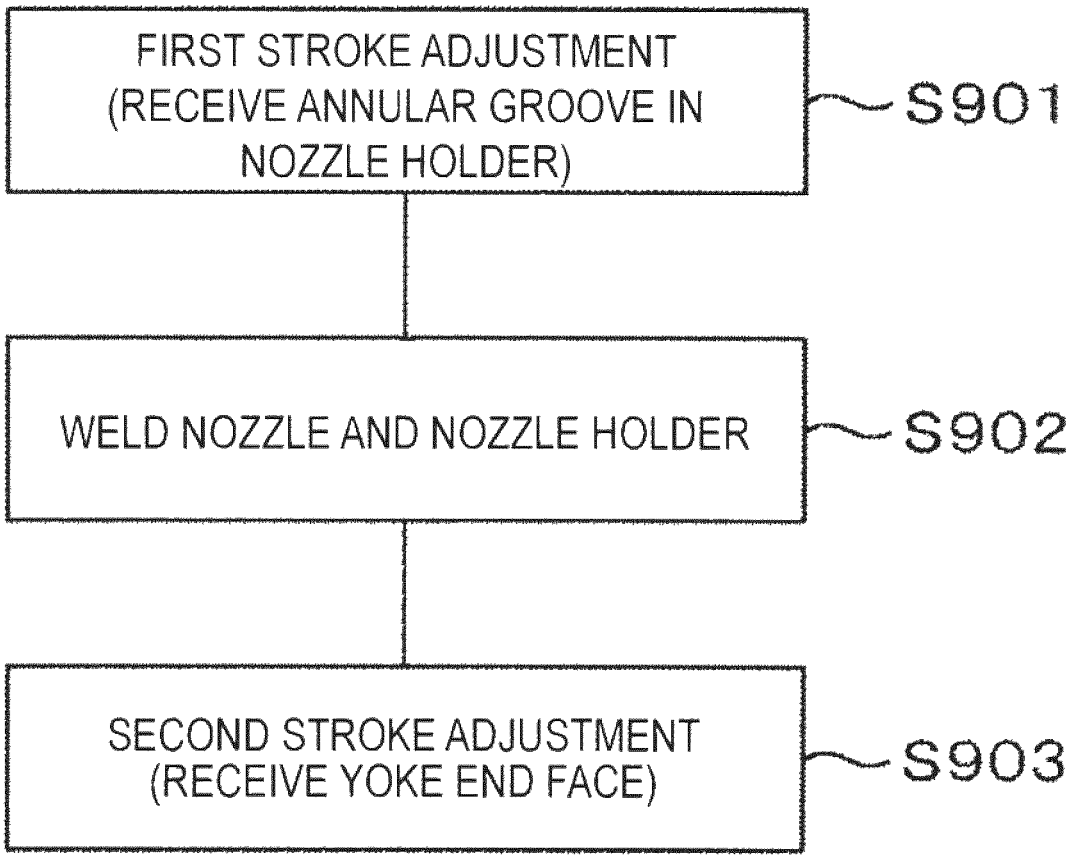
FIG. 9 shows a flowchart.

FIG. 8 shows a method for adjusting stroke in which load receiving positions are different between the first stroke adjustment and the second stroke adjustment and a deformable portion 4*d* is formed in advance on the nozzle holder 4. A flowchart of this process is shown in FIG. 9.

First, the first stroke adjustment is carried out (S901). The first stroke adjustment is carried out by receiving an annular groove 4*e* of the nozzle holder 4 with a retaining jig 60 so that the deformable portion 4*d* provided in advance is not deformed and pushing in the nozzle 12 with a jig 52. Control of the push-in mechanism 56 may be carried out in the same way as in the above-described embodiment. Although the annular groove 4*e* to be provided with a tip seal is utilized in the present embodiment, an annular groove for this purpose may be provided separately. However, the deformable portion 4*d* is provided in advance and a position (the annular groove 4*e*) to be received by the retaining jig 60 needs to be provided to a portion closer to the position to be pushed in by the jig 52 than the deformable portion 4*d*. In the first stroke adjustment, adjustment is carried out to cause the nozzle 12 to bite into the nozzle holder 4. After carrying out the first stroke adjustment, the nozzle 12 and the nozzle holder 4 are welded by the laser welding (S902). After carrying out the laser welding, the second stroke adjustment is carried out (S903). In the second stroke adjustment, the adjustment is carried out by plastically deforming the deformable portion 4*d* of the nozzle holder 4. The second stroke adjustment can be carried out in the same way as in the above-described embodiment by using the same device as that in FIG. 6. In other words, a yoke end face 3*a* is received by a retaining jig 51 and a tip end face of the nozzle 12 is pushed in by the jig 52. At this time, the deformable portion 4*d* needs to exist between the position to be received by the retaining jig 51 and the position to be pushed in by the jig 52.

In this method, the deformable portion 4*d* can be formed when the nozzle holder 4 is a part which is not yet mounted to a main body of a fuel injection valve 1 and therefore it is possible to manufacture the fuel injection valve at lower cost.

In each of the above-described embodiments, a load for pressing (compressing) is applied to the fuel injection valve 1 in each of the first and second stroke adjustments. However, at least in the second stroke adjustment, it is possible to apply the load so that tension acts on the deformable portion 4*d*. In this case, the amount S of stroke is preferably set to a small value in the first stroke adjustment.

In the present description, out of the load receiving positions in the stroke adjustments, the position of the fuel injection valve 1 where the load is applied by the load jig (or the pressing jig especially in the case of a pressing load) 52 may be distinguished as a load applied portion (or a pressed portion especially in the case of the pressing load) and the position of the fuel injection valve 1 to be supported by the support jig (or the pressing jig especially in the pressing load) 51 or 60 so that the pressing load by the load jig 52 is received may be distinguished as a supported portion (received portion).

The deformable portion 4*d* is provided between the load applied portion and the supported portion in the second stroke adjustment and is the portion having lower rigidity against the load in the valve axial direction 21 than the other portion between the load applied portion and the supported portion.

Although the methods for adjusting while measuring the amount of stroke have been described, it is also possible to adjust an amount of stroke by measuring a flow rate of the fuel injection valve and correcting a deviation from a target flow rate, for example.

REFERENCE SIGNS LIST

1 fuel injection valve
2 fixed core
3 yoke
4 nozzle holder
4*c* nozzle holder edge portion
5 movable member
8 valve element
8*a* valve seat portion
9 movable core
11 seat face
12 nozzle portion
13 guide
51, 60 retaining jig
52 jig
53 gage
54 measuring machine
55 controller
56 push-in mechanism

The invention claimed is:

1. A method for adjusting an amount of stroke of a movable member of a fuel injection valve including a nozzle member having a seat face, a nozzle holder member to which the nozzle member is joined by welding, and the movable member having a valve seat portion for coming in contact with the seat face, the method comprising applying a load to the nozzle member in a valve axial direction as a first stroke adjustment before joining the nozzle member and the nozzle holder member by welding;

joining the nozzle member and the nozzle holder member by welding; and plastically deforming a deformable portion provided to the nozzle holder member as a second stroke adjustment after joining the nozzle member and the nozzle holder member by welding, wherein the deformable portion is provided between a load applied portion of the fuel injection valve where a load for plastically deforming the deformable portion is applied and a supported portion of the fuel injection valve to be supported to receive the load and the deformable portion has lower rigidity in a valve axial direction against the load than the other portion between the load applied portion and the supported portion.

2. The method for adjusting the amount of stroke according to claim 1, wherein the first stroke adjustment is for adjusting relative positions of the nozzle member and the nozzle holder member in the valve axial direction.

3. A method for adjusting an amount of stroke of a movable member of a fuel injection valve including a nozzle member having a seat face, a nozzle holder member to which the nozzle member is joined by welding, and the movable member having a valve seat portion for coming in contact with the seat face, the method comprising applying a load to the nozzle member in a valve axial direction as a first stroke adjustment before joining the nozzle member and the nozzle holder member by welding;

joining the nozzle member and the nozzle holder member by welding; and plastically deforming a deformable portion provided to the nozzle holder member as a second stroke adjustment after joining the nozzle member and the nozzle holder member by welding, wherein the first stroke adjustment is for adjusting relative positions of the nozzle member and the nozzle holder member in the valve axial direction, wherein the first stroke adjustment is carried out by supporting a side of the nozzle holder member and applying a pressing load to the nozzle member to push the nozzle member into the nozzle holder member and the second stroke adjustment is carried out by supporting the side of the nozzle holder member and applying a pressing load to the nozzle member.

4. The method for adjusting the amount of stroke according to claim 3, wherein the supported portion of the fuel injection valve in the first stroke adjustment is positioned closer to the load applied portion than the supported portion in the second stroke adjustment.

5. The method for adjusting the amount of stroke according to claim 3, wherein the deformable portion is formed after carrying out the first stroke adjustment.

6. A fuel injection valve comprising:

a nozzle member having a seat face;

a nozzle holder member to which the nozzle member is joined by welding; and a movable member having a seat portion for coming in contact with the seat face, wherein the nozzle holder member comprises a deformable portion, which is easier to plastically deform than other portions of the nozzle holder member, wherein an amount of stroke of the movable member may be adjusted by applying a load to the nozzle member in a valve axial direction as a first stroke adjustment before the nozzle member and the nozzle holder member are joined by welding;

joining the nozzle member and the nozzle holder member by welding; and plastically deforming the deformable portion of the nozzle holder member as a second stroke adjustment after the nozzle member and the nozzle holder member are joined by welding, wherein the deformable portion is provided between a load applied portion of the fuel injection valve where a load for plastically deforming the deformable portion is applied and a supported portion of the fuel injection valve to be supported to receive the load and the deformable portion has lower rigidity in a valve axial direction against the load than the other portion between the load applied portion and the supported portion.

* * * * *